US011724279B2

(12) United States Patent
Chen

(10) Patent No.: US 11,724,279 B2
(45) Date of Patent: Aug. 15, 2023

(54) SPRAY HEAD AND CLEANING DEVICE HAVING THE SAME

(71) Applicant: TRIPLE WIN TECHNOLOGY(SHENZHEN) CO. LTD., Shenzhen (CN)

(72) Inventor: Ke-Quan Chen, Shenzhen (CN)

(73) Assignee: TRIPLE WIN TECHNOLOGY(SHENZHEN) CO. LTD., Shenzhen (CN)

( * ) Notice: Subject to any disclaimer, the term of this patent is extended or adjusted under 35 U.S.C. 154(b) by 388 days.

(21) Appl. No.: 16/941,803

(22) Filed: Jul. 29, 2020

(65) Prior Publication Data

US 2021/0114053 A1 Apr. 22, 2021

(30) Foreign Application Priority Data

Oct. 17, 2019 (CN) ..... 201921749508.6

(51) Int. Cl.

| | |
|---|---|
| ***B05B 15/65*** | (2018.01) |
| ***B08B 3/02*** | (2006.01) |
| ***B05B 1/04*** | (2006.01) |
| *B05B 15/652* | (2018.01) |

(52) U.S. Cl.

CPC ..... *B05B 15/65* (2018.02); *B05B 1/044* (2013.01); *B08B 3/02* (2013.01); *B05B 15/652* (2018.02); *B08B 3/026* (2013.01); *B08B 2203/02* (2013.01)

(58) Field of Classification Search

CPC ..... B08B 3/02; B08B 3/026; B08B 2203/02; B05B 15/65; B05B 15/652; B05B 1/044

See application file for complete search history.

(56) References Cited

U.S. PATENT DOCUMENTS

| | | | | | |
|---|---|---|---|---|---|
| 2,567,176 | A | * | 9/1951 | Ballard | B05B 1/1681 239/526 |
| 2,827,330 | A | * | 3/1958 | Baur | B05B 7/0815 239/528 |
| 3,116,020 | A | * | 12/1963 | Rosen | B05B 9/01 251/294 |
| 3,208,673 | A | * | 9/1965 | Kautz | B05B 7/0483 239/289 |
| 3,563,463 | A | * | 2/1971 | Walker | B05B 15/534 285/12 |
| 4,718,607 | A | * | 1/1988 | Levine | B05B 7/0416 239/597 |

(Continued)

*Primary Examiner* — Benjamin L Osterhout

(74) *Attorney, Agent, or Firm* — ScienBiziP, P.C.

(57) ABSTRACT

A spray head includes a nozzle, a sealing gasket, a first nut, and a screw. The nozzle includes an inlet portion, an outlet portion extending from an end of the inlet portion along an axial direction, and a first through hole penetrating the inlet portion and the outlet portion along the axial direction. The first through hole defines an opening on a surface of the outlet portion facing away from the inlet portion. The opening is rectangular. The sealing gasket is sleeved on the inlet portion. The first nut is sleeved on the nozzle and receiving the sealing gasket. The screw is located on a side of the sealing gasket facing away from the outlet portion and is engaged with the first nut. A second through hole penetrates the screw communicating with the first through hole. The disclosure also provides a cleaning device having the spray head.

16 Claims, 6 Drawing Sheets

(56) References Cited

U.S. PATENT DOCUMENTS

| | | | | | |
|---|---|---|---|---|---|
| 5,279,461 | A * | 1/1994 | Darroch | B05B 7/0815 | 239/296 |
| 5,307,994 | A * | 5/1994 | Hieronymus | B05B 7/2408 | 239/526 |
| 5,429,307 | A * | 7/1995 | Darroch | B05B 7/0081 | 239/527 |
| 5,855,321 | A * | 1/1999 | Hayes | B21J 3/00 | 451/449 |
| 6,547,160 | B1 * | 4/2003 | Huang | B05B 7/066 | 239/296 |
| 8,939,387 | B2 * | 1/2015 | Fontaine | B05B 15/65 | 239/528 |
| 10,639,658 | B1 * | 5/2020 | Enriquez | B05B 15/55 | |
| 2003/0057302 | A1 * | 3/2003 | Swan | B05B 7/0425 | 239/599 |
| 2003/0173419 | A1 * | 9/2003 | Huang | B05B 7/0815 | 239/296 |
| 2005/0242207 | A1 * | 11/2005 | Tejeda | B05B 7/1272 | 239/338 |
| 2006/0065761 | A1 * | 3/2006 | Joseph | B05B 15/50 | 239/291 |
| 2008/0029619 | A1 * | 2/2008 | Gohring | B05B 7/083 | 239/596 |
| 2013/0168471 | A1 * | 7/2013 | Chen | B05B 12/0024 | 239/526 |
| 2013/0341423 | A1 * | 12/2013 | Dziubasik | F25C 3/04 | 239/14.2 |
| 2014/0077002 | A1 * | 3/2014 | Krayer | B05B 1/3046 | 239/458 |
| 2016/0339458 | A1 * | 11/2016 | Fu | B05B 7/2435 | |

* cited by examiner

SPRAY HEAD AND CLEANING DEVICE HAVING THE SAME

FIELD

The subject matter herein generally relates to a spray head and a cleaning device having the spray head.

BACKGROUND

Existing nozzles used for cleaning are usually single-hole spot shots, and the jetted water stream presents a small water column. The water stream can only spread in dots on the surface of the object to be cleaned. The dot diffusion cannot fully cover the surface of the object to be cleaned, and it is easy to cause some areas to be missed for cleaning.

Therefore, there is room for improvement within the art.

BRIEF DESCRIPTION OF THE DRAWINGS

Implementations of the present disclosure will now be described, by way of embodiments, with reference to the attached figures.

DETAILED DESCRIPTION

Figure 1:
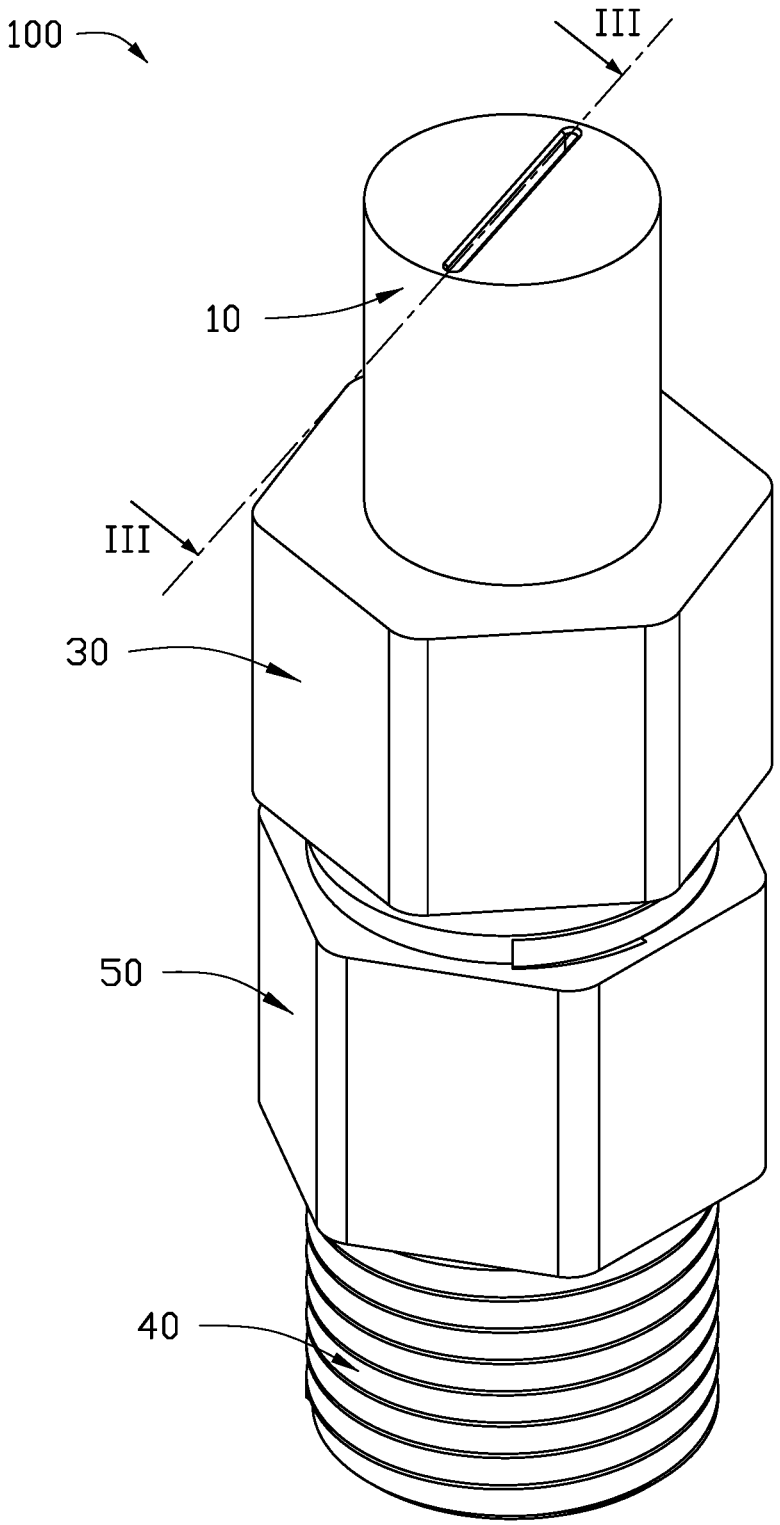
FIG. 1 is a diagram of an embodiment of a spray head.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale, and the proportions of certain parts may be exaggerated to better illustrate details and features of the present disclosure.

The disclosure is illustrated by way of example and not by way of limitation in the figures of the accompanying drawings, in which like references indicate similar elements. It should be noted that references to "an" or "one" embodiment in this disclosure are not necessarily to the same embodiment, and such references mean "at least one."

The term "comprising," when utilized, means "including, but not necessarily limited to"; it specifically indicates open-ended inclusion or membership in the so-described combination, Group, series, and the like.

Figure 2:
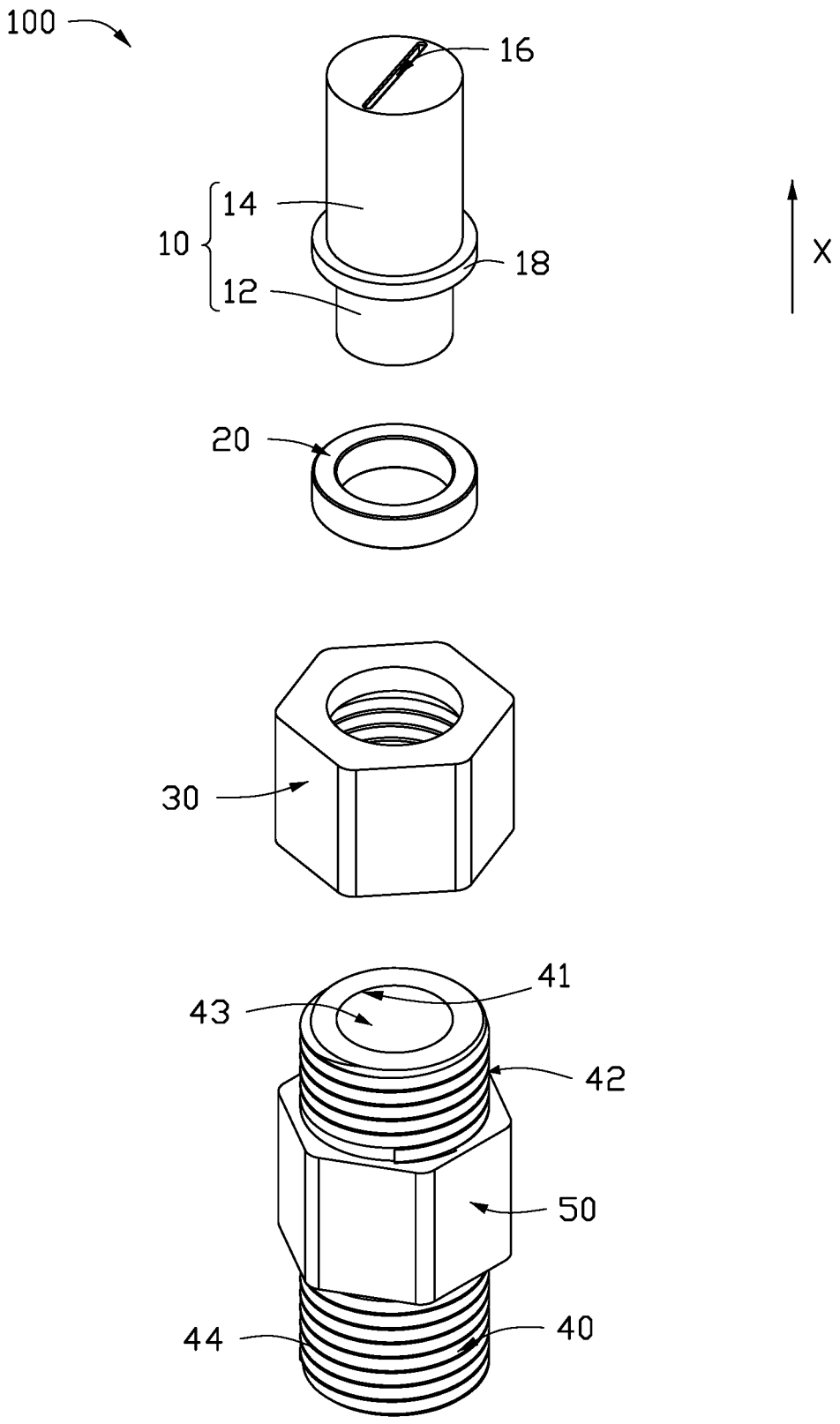
FIG. 2 is an exploded, diagrammatic view of an embodiment of the spray head of FIG. 1.

FIG. 1 illustrates an embodiment of an embodiment of a spray head 100 for spraying a cleaning liquid on an object to clean the object. Referring to FIG. 2, the spray head 100 includes a nozzle 10, a sealing gasket 20, a first nut 30 and a screw 40.

Figure 3:
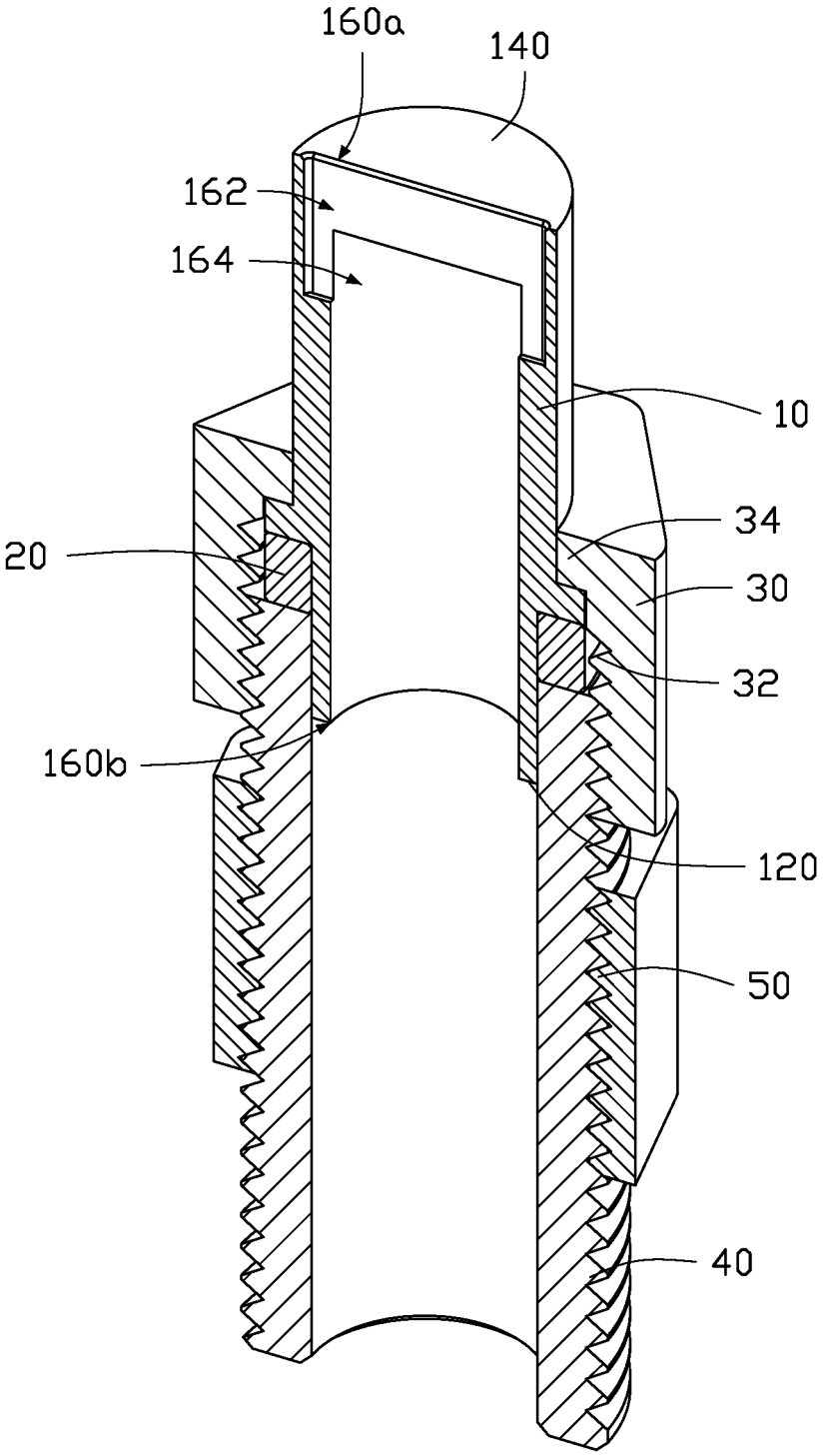
FIG. 3 is a cross-sectional view of an embodiment of the spray head of FIG. 1.

The nozzle 10 is substantially a cylindrical structure. The nozzle 10 includes an inlet portion 12 and an outlet portion 14 extending from an end of the inlet portion 12 along an axial direction X. The nozzle 10 further includes a first through hole 16. Referring to FIG. 3, the first through hole 16 penetrates the inlet portion 12 and the outlet portion 14 in the axial direction X, a first opening 160*a* is defined on a first surface 140 of the outlet portion 14 facing away from the inlet portion 12, and a second opening 160*b* is defined on a second surface 120 of the inlet portion 12 facing away from the outlet portion 14. The cleaning liquid enters from the inlet portion 12 and is ejected from the outlet portion 14 onto the object.

Figure 4:
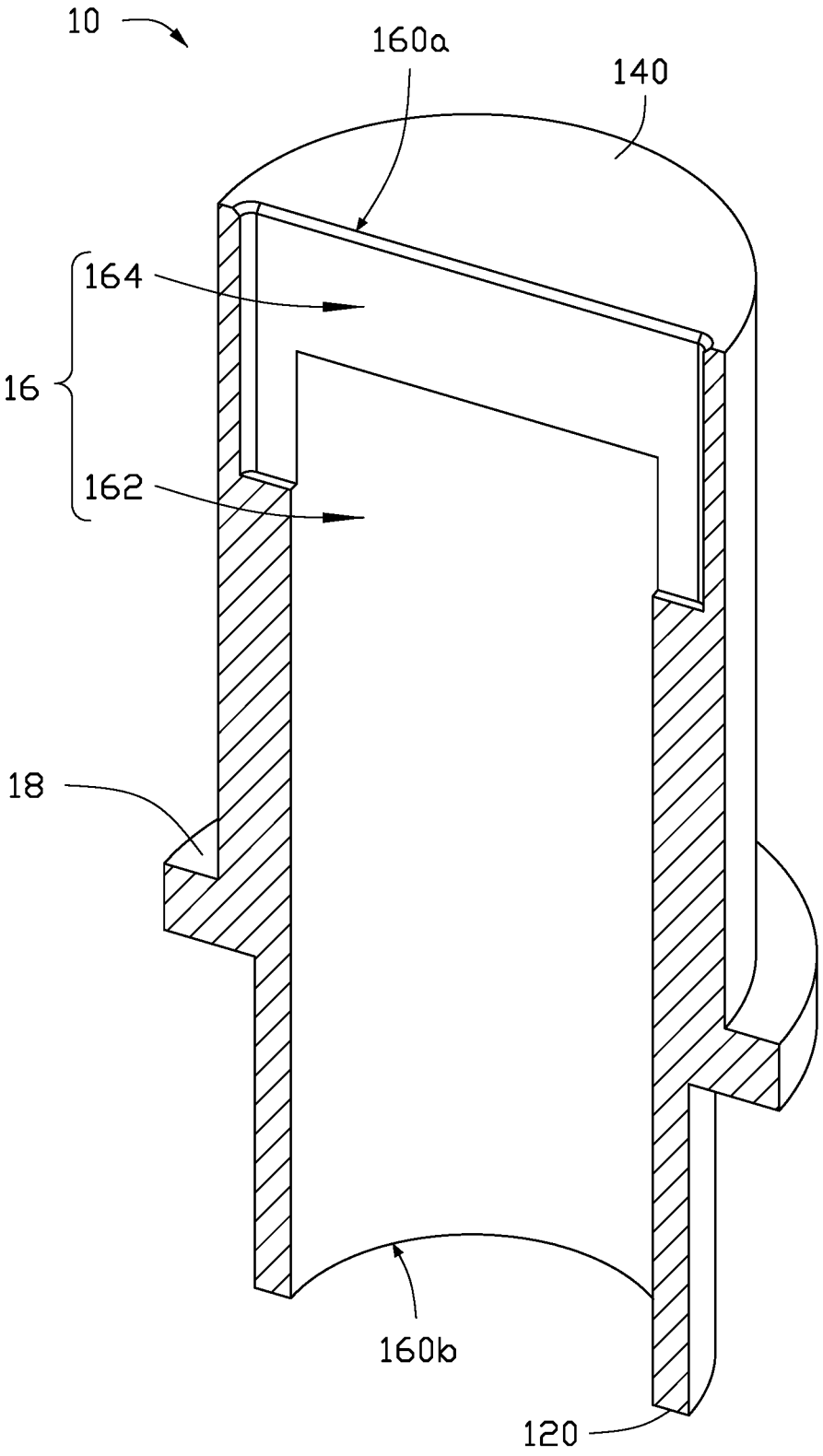
FIG. 4 is a cross-sectional view of an embodiment of a nozzle.

In at least one embodiment, referring to FIG. 4, the first through hole 16 includes a first portion 162 and a second portion 164 communicating with the first portion 162. The first portion 162 penetrates the inlet portion 12 and extends in the outlet portion 14. The second portion 164 is formed in the outlet portion 14 and penetrates the first surface 140 of the outlet portion 14 facing away from the inlet portion 12 to define the first opening 160. An end of the second portion 164 facing away from the first opening 160 communicates with the first portion 162.

A sectional area of the first portion 162 perpendicular to the axial direction X is greater than a sectional area of the second portion 164 perpendicular to the axial direction X.

In at least one embodiment, the first portion 162 has a cylindrical shape to uniformly disperse of the pressure of the cleaning liquid when the cleaning liquid enters the first portion 162. The second portion 164 has a rectangular shape, so that the cleaning liquid is ejected to be flat from the second portion 164 to clean the object.

A protruding portion 18 protrudes from an outside surface of the nozzle 10, and is separated from the first surface 140 and the second surface 120. The protruding portion 18 is located between the inlet portion 12 and the outlet portion 14. In at least one embodiment, the protruding portion 18 is annular to surround the nozzle 10.

The sealing gasket 20 is a ring. The sealing gasket 20 is sleeved on the inlet portion 12 and abuts against a side of the protruding portion 18 away from the outlet portion 14. The protruding portion 18 prevent the sealing gasket 20 from the inlet portion 12 to the outlet portion 14.

Figure 5:
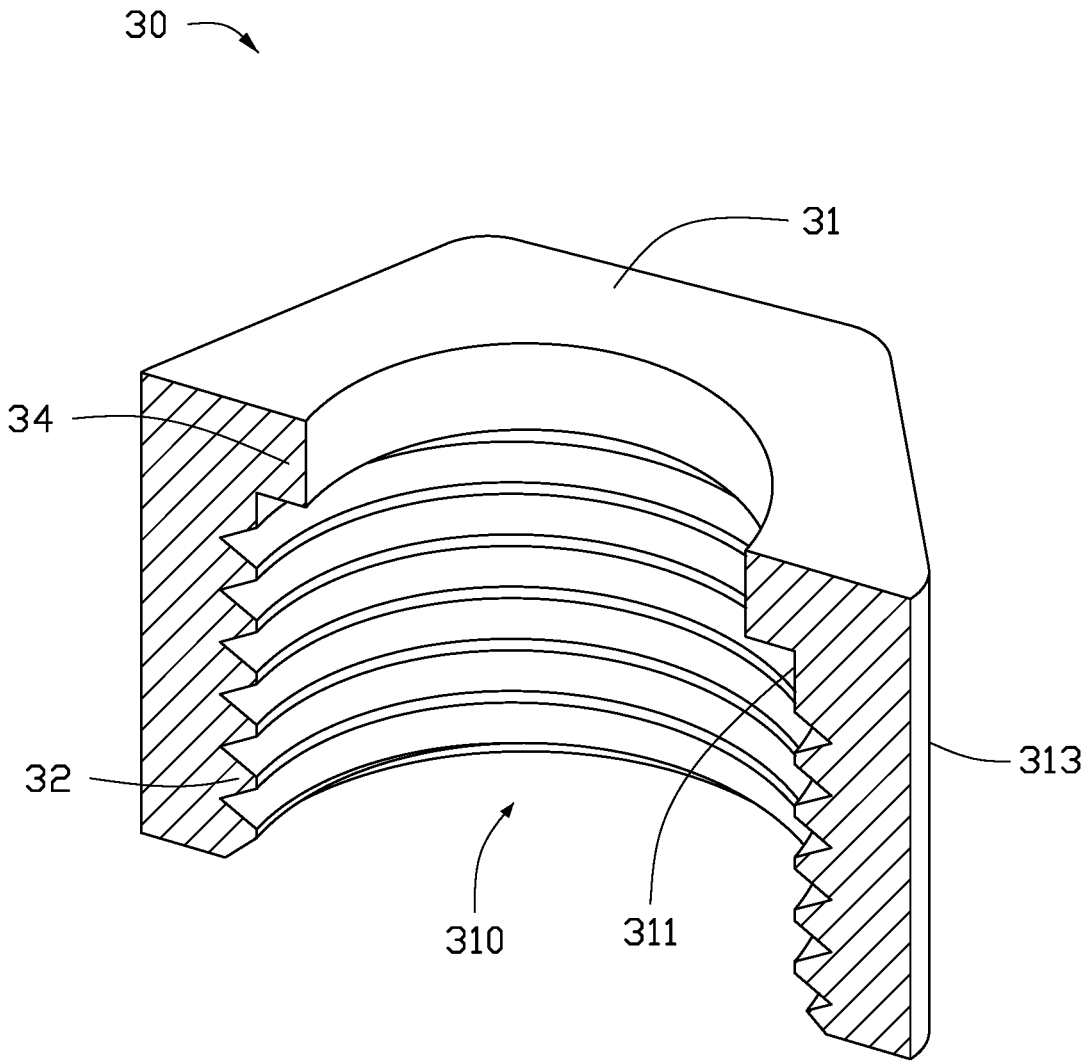
FIG. 5 is a cross-sectional view of an embodiment of a first nut.

Referring to FIG. 5, the first nut 30 includes a nut body 31. A connecting hole 310 penetrates the nut body 31. The nut body 31 includes an inner surface 311 and an outer surface 313 facing away from the inner surface 311. The inner surface 311 surrounds to form the connecting hole 310. A first thread 32 is formed on the inner surface 311. A stopping portion 34 protrudes from an end portion of the inner surface 311 toward a central axis of the connecting hole 310. The first nut 30 is sleeved on the nozzle 10. The sealing gasket 20 and the protruding portion 18 are received in the connecting hole 310. The stopping portion 34 is sleeved on the outlet portion 14, and abuts against a side of the protruding portion 18 away from the inlet portion 12. The protruding portion 18 prevent the stopping portion 34 from the outlet portion 14 to the inlet portion 12.

A second thread 44 is formed on an outside surface 42 of the screw 40. An end portion of the screw 40 is received in the connecting hole 310 from an end portion of the first nut 30 facing away from the stopping portion 34, and abuts against a side of the sealing gasket 20 facing away from the protruding portion 18. The second thread 44 cooperates with the first thread 32 to fix the first nut 30 and the screw 40 together. A second through hole 43 penetrates the screw 40, and communicates with the first through hole 16.

In at least one embodiment, the screw 40 may be partially sleeved on the inlet portion 12 and located a side of the sealing gasket 20 facing away from the protruding portion 18.

The stopping portion 34 and the screw 40 restrict a movement of the nozzle 10 in the axial direction X. The nozzle 10 can freely rotate around the axial direction X compared to the first nut 30. When the spray head 100 is applied in a cleaning device 200 (shown in FIG. 6), a direction of the cleaning liquid sprayed may be changed by rotating the nozzle 10. The nozzle 10 can be rotate 360°, which makes it easier to clean the objects.

A second nut 50 is movably sleeved on the screw 40 to be used to connect the screw 40 to an component of the cleaning device 200 that can provide the cleaning liquid.

Figure 6:
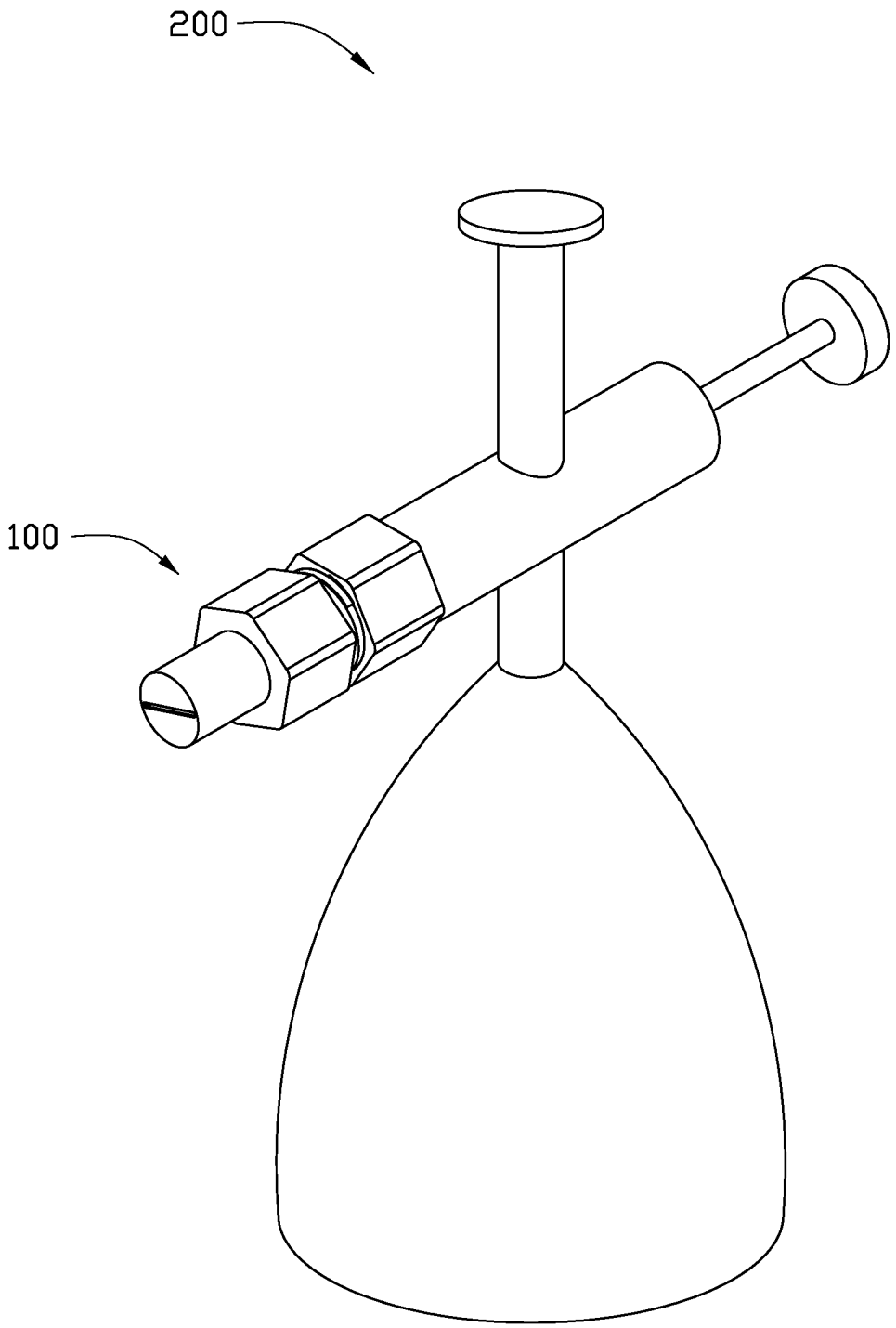
FIG. 6 is a diagram of an embodiment of a cleaning device.

FIG. 6 illustrates an embodiment of an embodiment of a cleaning device 200. The cleaning device 200 includes the above spray head 100.

It is to be understood, even though information and advantages of the present embodiments have been set forth in the foregoing description, together with details of the structures and functions of the present embodiments, the disclosure is illustrative only; changes may be made in detail, especially in matters of shape, size, and arrangement of parts within the principles of the present embodiments to the full extent indicated by the plain meaning of the terms in which the appended claims are expressed.

What is claimed is:

1. A spray head comprising:

a nozzle, the nozzle comprising an inlet portion, an outlet portion extending from an end of the inlet portion along an axial direction, and a first through hole penetrating the inlet portion and the outlet portion along the axial direction, the first through hole defining an opening on a surface of the outlet portion facing away from the inlet portion, the opening being rectangular;

a sealing gasket sleeved on the inlet portion;

a first nut sleeved on the nozzle and receiving the sealing gasket; and a screw next to a side of the sealing gasket facing away from the outlet portion and engaged with the first nut, a second through hole penetrating the screw communicating with the first through hole;

wherein the nozzle freely rotates around the axial direction in the first nut.

2. The spray head of claim 1, wherein a protruding portion protrudes from an outside surface of the nozzle, and is located between the inlet portion and the outlet portion; the sealing gasket abuts against a side of the protruding portion away from the outlet portion.

3. The spray head of claim 2, wherein the protruding portion is annular to surround the nozzle.

4. The spray head of claim 2, wherein the first nut comprises a nut body and a connecting hole penetrating the nut body, the nut body comprises an inner surface and an outer surface facing away from the inner surface, the inner surface surrounds to form the connecting hole, a stopping portion protrudes from an end portion of the inner surface toward a central axis of the connecting hole, the stopping portion is sleeved on the outlet portion, and abuts against a side of the protruding portion away from the sealing gasket, a first thread is formed on the inner surface and the first thread is engaged with the screw.

5. The spray head of claim 2, wherein an end portion of the screw abuts against a side of the sealing gasket facing away from the protruding portion.

6. The spray head of claim 1, wherein the first through hole comprises a first portion and a second portion communicating with the first portion, the first portion penetrates the inlet portion and extends in the outlet portion, the second portion is formed in the outlet portion and penetrates the surface of the outlet portion facing away from the inlet portion to define a first opening.

7. The spray head of claim 6, wherein a sectional area of the first portion perpendicular to the axial direction is greater than a sectional area of the second portion perpendicular to the axial direction.

8. The spray head of claim 1, wherein the spay head further comprises a second nut, the second nut is movably sleeved on the screw.

9. A cleaning device comprising:

a spray head comprising:

a nozzle, the nozzle comprising an inlet portion, an outlet portion extending from an end of the inlet portion along an axial direction, and a first through hole penetrating the inlet portion and the outlet portion along the axial direction, the first through hole defining an opening on a surface of the outlet portion facing away from the inlet portion, the opening being rectangular;

a sealing gasket sleeved on the inlet portion;

a first nut sleeved on the nozzle and receiving the sealing gasket; and a screw next to a side of the sealing gasket facing away from the outlet portion and engaged with the first nut, a second through hole penetrating the screw communicating with the first through hole;

wherein the nozzle freely rotates around the axial direction in the first nut.

10. The cleaning device of claim 9, wherein a protruding portion protrudes from an outside surface of the nozzle, and is located between the inlet portion and the outlet portion; the sealing gasket abuts against a side of the protruding portion away from the outlet portion.

11. The cleaning device of claim 10, wherein the protruding portion is annular to surround the nozzle.

12. The cleaning device of claim 10, wherein the first nut comprises a nut body and a connecting hole penetrating the nut body, the nut body comprises an inner surface and an outer surface facing away from the inner surface, the inner surface surrounds to form the connecting hole, a stopping portion protrudes from an end portion of the inner surface toward a central axis of the connecting hole, the stopping portion is sleeved on the outlet portion, and abuts against a side of the protruding portion away from the sealing gasket, a first thread is formed on the inner surface and the first thread is engaged with the screw.

13. The cleaning device of claim 10, wherein an end portion of the screw abuts against a side of the sealing gasket facing away from the protruding portion.

14. The cleaning device of claim 9, wherein the first through hole comprises a first portion and a second portion communicating with the first portion, the first portion penetrates the inlet portion and extends in the outlet portion, the second portion is formed in the outlet portion and penetrates the surface of the outlet portion facing away from the inlet portion to define a first opening.

15. The cleaning device of claim 14, wherein a sectional area of the first portion perpendicular to the axial direction is greater than a sectional area of the second portion perpendicular to the axial direction.

16. The cleaning device of claim 9, wherein the spray head further comprises a second nut, the second nut is movably sleeved on the screw.

* * * * *